US006245000B1

(12) United States Patent
Saakian et al.

(10) Patent No.: US 6,245,000 B1
(45) Date of Patent: Jun. 12, 2001

(54) EXERCISE DEVICE AND BODY TONER WITH ADJUSTABLE INCLINED ROLLER PLATFORM

(76) Inventors: Anna Saakian, 10-4656 Sherbrooke Street West, Montreal, Quebec (CA), H3Z 1G3; Guido Perrella, 2006-4175 St. Catherine Street West, Westmount, Quebec (CA), H3Z 3C9

( * ) Notice: Subject to any disclaimer, the term of this patent is extended or adjusted under 35 U.S.C. 154(b) by 0 days.

(21) Appl. No.: 09/377,430

(22) Filed: Aug. 19, 1999

(51) Int. Cl.[7] ..... A63H 15/00

(52) U.S. Cl. ..... 482/142; 482/907; 601/115; 601/122

(58) Field of Search ..... 601/24, 115, 122, 601/128; 482/142, 130, 907; 606/243, 244, 245, 246

(56) References Cited

U.S. PATENT DOCUMENTS 1,322,720 * 11/1919 Noble ..... 482/142
1,836,981 12/1931 Matheson .
2,840,072 * 6/1958 Stearns ..... 601/115
4,867,142 * 9/1989 Jones ..... 128/57
5,393,287 2/1995 Papapaschalis .
5,634,887 * 6/1997 Fortier ..... 601/115
5,674,185 * 10/1997 Chang ..... 601/122
5,833,590 * 11/1998 Chiu et al. ..... 482/142

* cited by examiner

*Primary Examiner*—Jerome W. Donnelly
(74) *Attorney, Agent, or Firm*—McCormick, Paulding & Huber LLP

(57) ABSTRACT

An exerciser with an inclined adjustable roller platform assembly comprising a base module, a roller platform assembly, a foot support, a roller platform assembly support, an overhead hand bar assembly and an overhead hand bar assembly support, one end of the roller platform assembly is pivotally connected to the base, the foot support fastened to and extending forwardly of the base of the roller platform assembly, the adjustable roller platform assembly is maintained in one of many variable inclined positions by the roller platform assembly support extending between the roller platform assembly and the base module, the roller platform assembly support being variably vertically adjustable; the overhead hand bar assembly having a lower end pivotally connected to the roller platform assembly, overhead hand bar assembly supports extending between the overhead hand bar assembly and the roller platform assembly, the overhead hand bar supports being variably vertically adjustable.

9 Claims, 9 Drawing Sheets

EXERCISE DEVICE AND BODY TONER WITH ADJUSTABLE INCLINED ROLLER PLATFORM

SUMMARY OF THE INVENTION

This invention is in the field of exercise devices. The invention relates to an inclined exercise device in which the inclination of the exercise device is adjustable between twenty-five degrees and seventy-five degrees relative to horizontal. More particularly the invention relates to an exercise device having an inclined roller platform assembly and overhead hand bar assembly in which the incline of the roller platform assembly and the incline of the overhead hand bar assembly relative to horizontal are adjustable. The combination of the inclined roller platform assembly and the overhead bar assembly permit the user to select exercises for selected body muscles. Part of the body is constantly in contact with the roller platform assembly providing massaging while exercising the selected body muscles.

BACKGROUND OF THE INVENTION

Many people who would like to use exercise devices find that they do not have sufficient strength to do chin-ups, push ups, squats or other exercises in which their full body weight must be raised against the force of gravity. One solution to this problem is the use of vertical supports, pulleys and wires in which adjustable weights are substituted for body weight or partial body weight. In this invention the body weight is supported on an inclined roller platform assembly.

The inclined roller platform assembly by reason of the angle of inclination supports more of the user's body weight when relatively flat and less of the user's body weight when in a more vertical position. The overhead hand bar assembly may be arranged at different inclinations relative to the inclined roller platform assembly. The exerciser may be used for both stretching and strengthening exercise by adjusting the inclination of the roller platform assembly and the overhead hand bar assembly. The roller platform assembly including a set of interspaced rollers supports a good portion of the body weight when the roller platform assembly is set at an inclination of twenty-five degrees relative to horizontal. The exerciser may be used for chin-ups, sit-ups, squats and like exercises. As part of the body of the user is in contact with the rollers of the roller platform assembly the rollers apply pressure to the portion of the body in contact with the rollers of the roller platform assembly while strengthening and stretching exercises are conducted by grasping a selected transverse support of the overhead hand bar assembly and carrying out sit-ups, chin-ups, squats or stretching exercises. The roller platform assembly includes foot supports which may be used to perform squats and similar exercises where calf and thigh muscles are used to move the body relative to the inclined roller platform.

In the prior art, U.S. Pat. No. 5,393,287 to Papapaschalis discloses an exercise device which includes a series of rolling spindles upon which the person using the device rests their body. The patent does not disclose an inclined roller platform assembly with an adjustable incline combination with foot supports as shown in the instant invention. The combination of an inclined roller platform assembly, foot supports and overhead hand bar assembly results in less pressure being exerted by the body on the rolls of the roller bar assembly of U.S. Pat. No. 5,393,287. In addition the instant invention provides a framework for a multiplicity of strengthening and stretching exercises requiring different force not available on the rolling spindles of the device disclosed in U.S. Pat. No. 5,393,287 to Papapaschalis. U.S. Pat. No. 1,836,981 issued to W. A. Matheson for an invention entitled "Massaging and Exercising Apparatus". This invention discloses a roller platform having a series of rollers extending from side to side of the roller platform. Handles 36 may be utilized to move the user back and forth over the rollers. Another exercise which may be performed is a rowing exercise. U.S. Pat. No. 1,836,981 does not disclose an inclined roller platform assembly in which the incline relative to horizontal may be adjusted between 25 and 75 degrees, nor does U.S. Pat. No. 1,836,981 disclose an overhead hand bar assembly which may be adjusted relative to the inclined roller platform assembly to provide different hand grip positions for the user as disclosed in the exerciser of this invention. The current invention provides an exerciser on which many different types of strengthening or stretching exercises may be performed. The vertical adjustment of the exerciser may be controlled to increase or decrease the strenuousness of the exercise.

DESCRIPTION OF THE PREFERRED EMBODIMENTS

Figure 1:
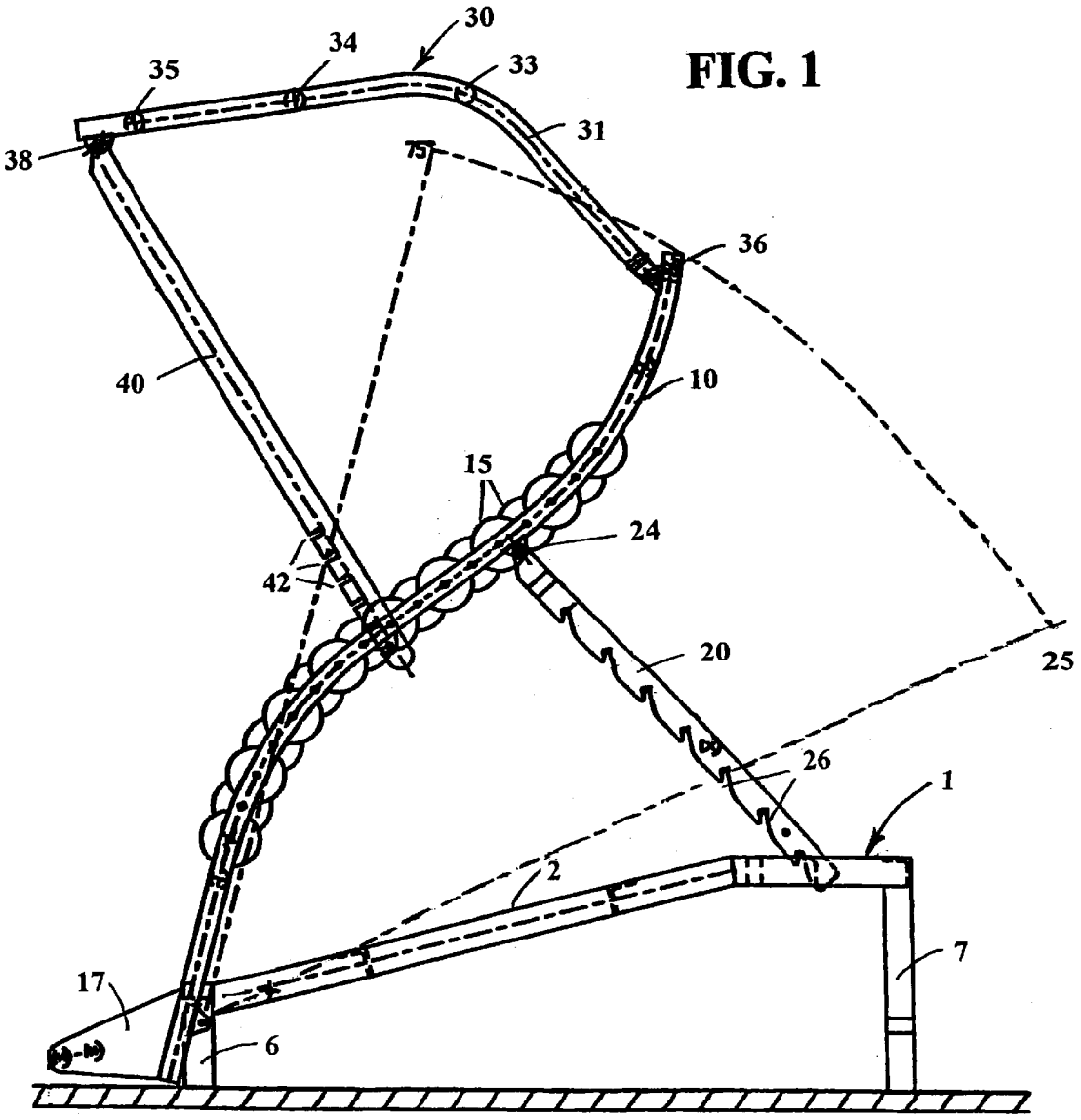
FIG. 1 is a side elevation view of the exerciser showing the roller platform assembly secured at an inclined position of seventy-five degrees relative to horizontal.

Referring to FIG. 1 there is shown an exerciser with inclined components whose inclination is adjustable. The exerciser has a base module 1. The base module 1 has sides 2, 3 joined together at either end by transverse bars 4, 5. Legs 6, 7 extend vertically downward from each corner of base module 1 where sides 2 and 3 meet transverse bars 4, 5. The back legs 7 are longer than front legs 6.

Figure 4:
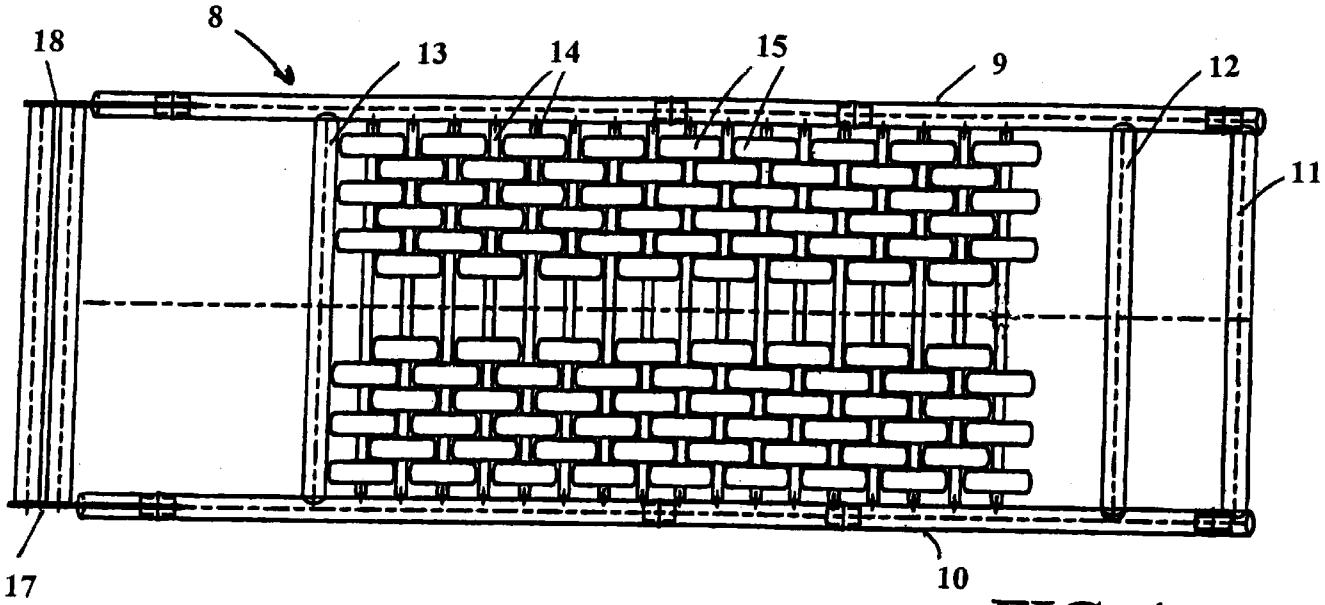
FIG. 4 is a top view of the roller platform assembly.
Figure 5:
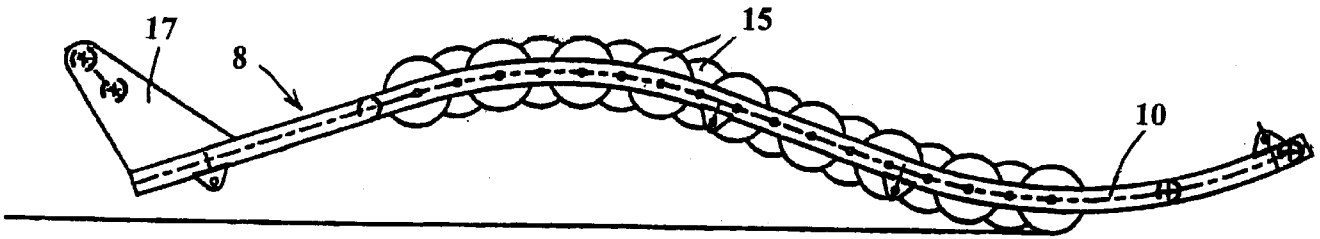
FIG. 5 is a side elevation view of the roller platform assembly.
Figure 6:
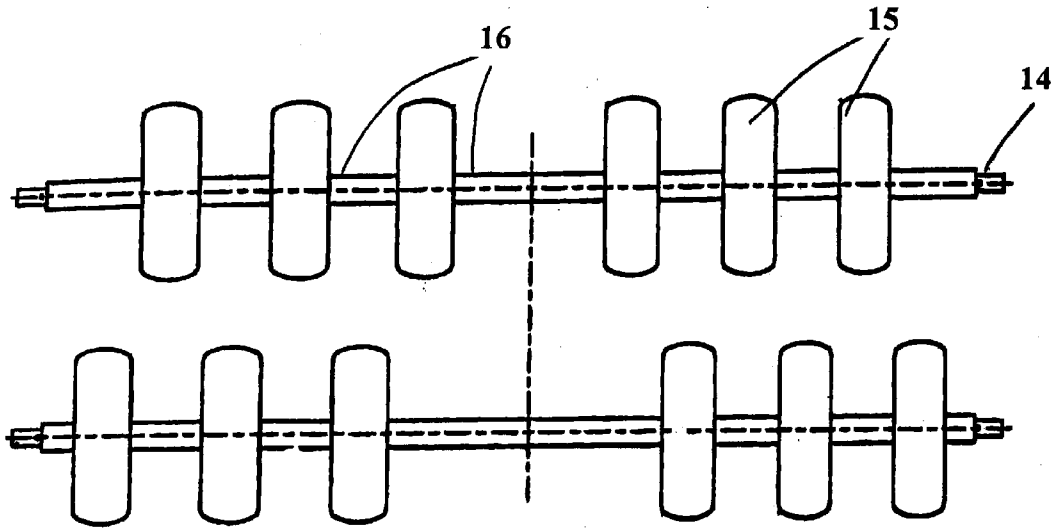
FIG. 6 is a top elevation view of two rows of rollers showing the offset of rollers which enables one row of rollers to be interspersed within the radius of the rollers of the preceding and following row of rollers.

Referring to FIGS. 1, 4 and 5 there is shown a roller platform assembly 8. As best seen in FIG. 4 the roller platform assembly 8 has sides 9, 10 and transverse frame members 11, 12 and 13. A series of spaced roller rods 14 extend parallel to one another from side 9 to side 10 of roller platform assembly 8. As best seen in FIG. 6 rollers 15 are mounted for rotation on roller rods 14. A series of roller bushings 16 are mounted on roller rods 14 between adjoining rollers 15 and between the outermost rollers 15 and sides 9 and 10 to retain the spacing between rollers 15. The spacing between adjoining roller rods 14 is slightly greater than the diameter of rollers 15. By the selection and arrangement of roller bushings on adjoining roller rods 14 the outer part of rollers 15 on roller rods 14 are located between the outer part of rollers 15 on adjoining roller rods 14. The interspersal of rollers 15 of adjoining rows of rollers 15 provides more contact with the body of the user than roller platforms in which rollers of adjoining lines of rollers are not interspersed. The center of the roller platform assembly is comprised of roller bushings 16 so that no pressure is exerted on the centre front or back of the user's body. As seen in FIG. 5 the sides 9, 10 of the roller platform assembly 8 is in the shape of an elongated S. Extending from the base of sides 9, 10 are flanges 17 and 18. Foot supports 19, 20 extend transversely across the base of roller platform assembly 8 between flanges 17, 18.

Figure 2:
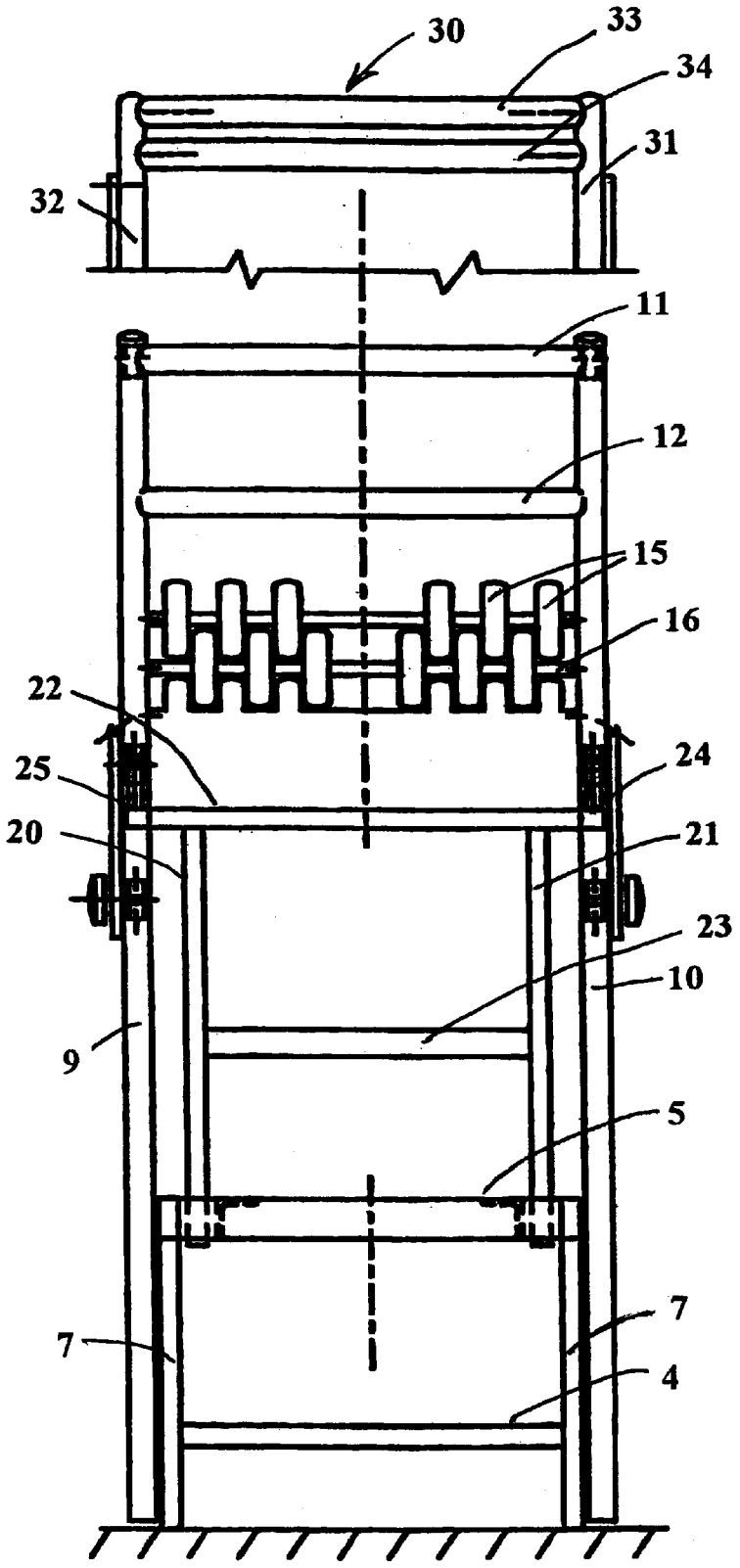
FIG. 2 is a rear end view of the exerciser showing a partial view of the rollers and a cut off view of the top of the overhead hand bar assembly.
Figure 3:
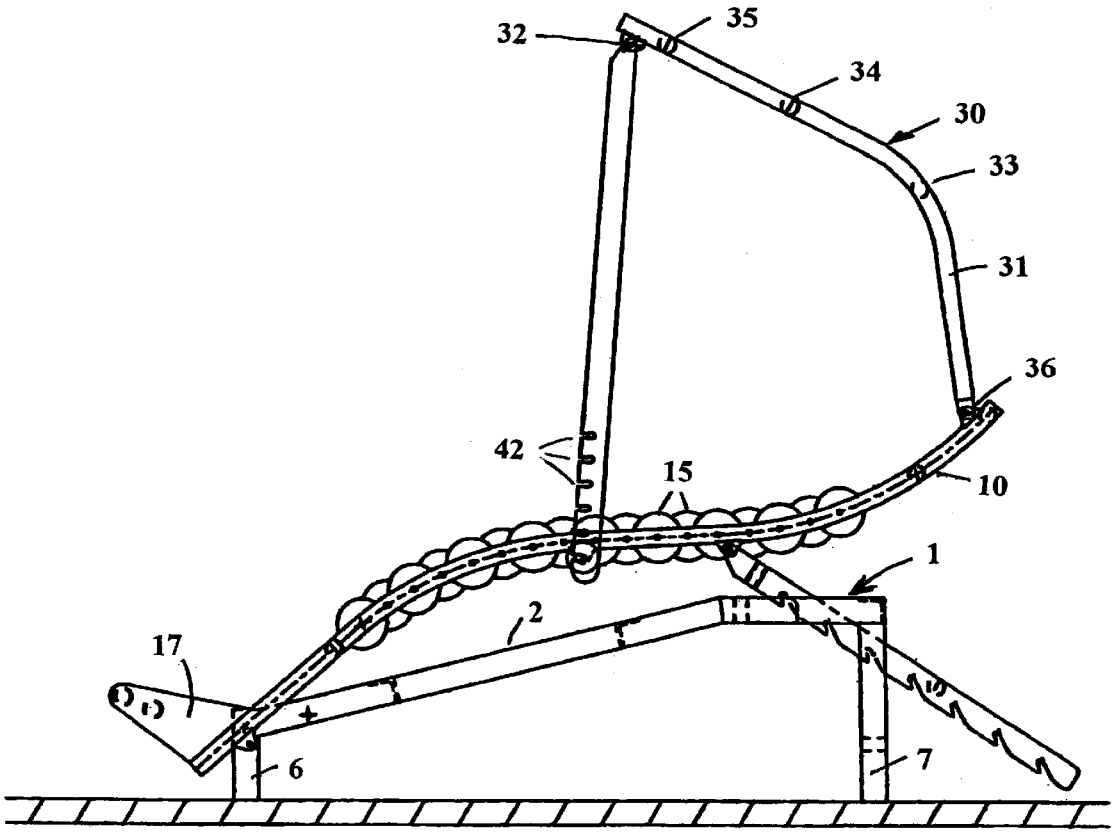
FIG. 3 is a side elevation view of the exerciser showing the roller platform assembly secured at an inclined position of twenty-five degrees relative to horizontal.

As seen in FIGS. 1 and 2 the roller platform assembly supports 20, 21 are connected by transverse roller platform assembly rod 22. A second transverse rod 23 is connected between roller platform assembly supports 20, 21 around midlength of roller platform assembly supports 20, 21. Roller platform assembly rod 22 is pivotally supported within apertures defining openings in flanges 24 and 25 extending from sides 9, 10 of roller platform assembly 8. The lower parts of roller platform assembly supports 20, 21 include a series of downwardly spaced notches 26. Selected notches 26 of roller platform assembly supports 20, 21 are engaged on transverse roller platform assembly transverse support rod 27 which extends from side 6 to side 7 of the base module. As seen in FIG. 1, the lowest notches 26 of roller platform assembly supports 20, 21 are indexed in transverse support rod 27. With the roller platform assembly supports in the position shown in FIG. 1 the roller platform assembly or at least the base thereof is at seventy-five degrees relative to horizontal. A segment of a circle is indicated by dotted lines in FIG. 1. The segment extends from twenty-five degrees to seventy-five degrees from vertical. In FIG. 1 the roller platform assembly is shown at seventy-five degrees relative to horizontal. In FIG. 3 the roller platform assembly 8 is shown at twenty-five degrees relative to horizontal. The shift in inclination of the roller platform assembly 8 shown in FIG. 1 to FIG. 3 is achieved by raising the lowermost notches 26 of the roller platform assembly supports 20, 21 from transverse support rod 27 and lowering the roller platform assembly supports 20, 21 relative to the base module 1 and then engaging the uppermost notches 26 of roller platform assembly supports 20, 21 on transverse support rod 27. The roller platform assembly 8 then has a verticality of twenty-five degrees relative to horizontal as shown in FIG. 3.

Referring to FIGS. 1 and 2 the overhead hand bar assembly 30 is comprised of side bars 31, 32 which are supported by and in turn support transverse supports 33, 34 and 35. Side bars 31, 32 of the overhead hand bar assembly 30 are relatively straight at either end with a central downward concave bend proximate the middle of side bars 31, 32.

Flanges 36, 37 extend upwardly from the sides 9, 10 of roller platform assembly module 8 proximate the upper end of the sides 9, 10. One end of side bars 31, 32 is pivotally connected to the flanges 36, 37. The opposite ends of side bars 31, 32 of overhead hand bar assembly 30 have fastened to the ends thereof downwardly extending flanges 38, 39 with apertures therein defining openings. Overhead hand bar assembly supports 40, 41 are pivotally connected at their upper end to flanges 36, 37 of side bars 31, 32 of overhead hand bar assembly 30. The lower part of overhead hand bar assembly supports 40, 41 include a series of indexed notches 42 on one edge. A selected one of notches 42 is inserted on a rod 43 which extends transversely from sides 9 to 10 of roller platform assembly 8. The distance of the overhead hand bar assembly 30 relative to the roller platform assembly 8 is varied by selecting a notch 42 for insertion on rod 43 to obtain the desired distance. The distance of the overhead hand bar assembly 30 from the roller platform assembly selected will depend upon the size of the person using the exerciser, the inclination of the roller platform assembly and the extent of movement of the person using the exerciser relative to the roller platform assembly 8.

Figure 7A:
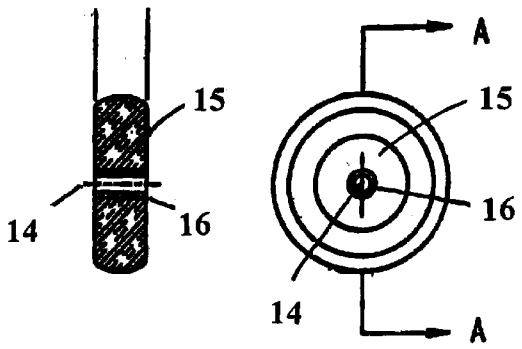
FIG. 7A is a cross section of an elastomer roller.
Figure 7B:
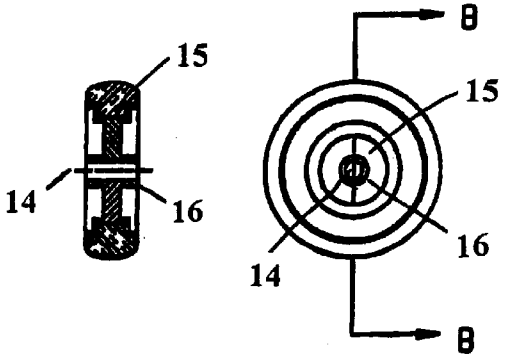
FIG. 7B is a cross-section of a roller having a solid core supporting an elastomer circumferential band.
Figure 8:
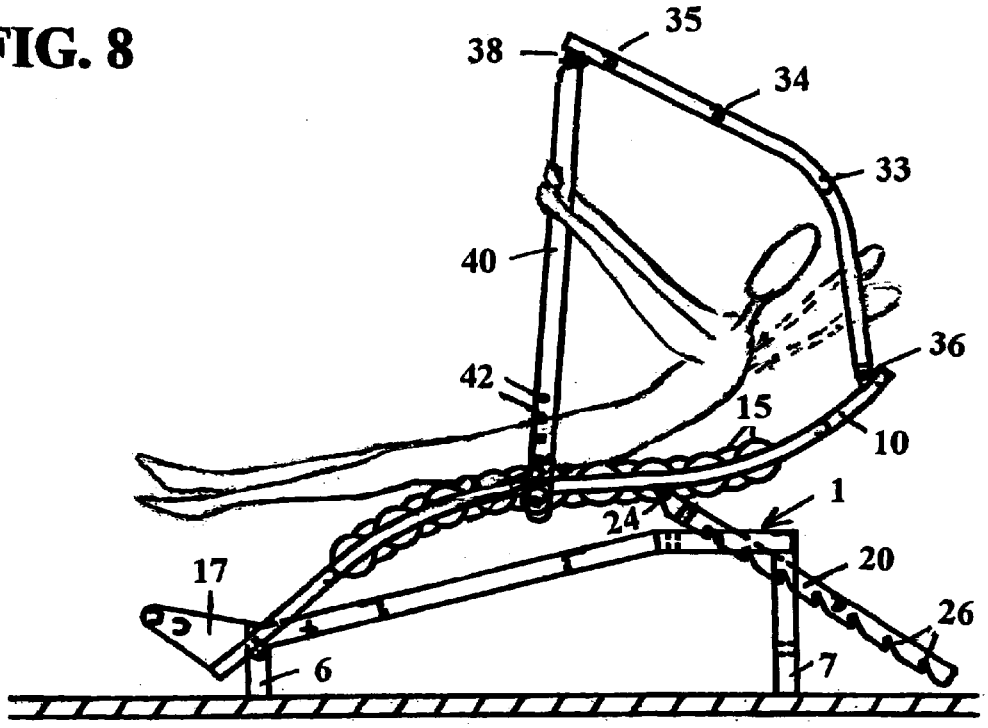
FIG. 8 is a cross-sectional view of the exerciser in a lower incline position with a user performing sit-ups.

Referring to FIG. 7A there is shown a roller 15 having a wheel made of elastomeric material such as rubber. FIG. 7B shows in cross-section a wheel having a central support supporting a circumferential elastomeric band. Referring to FIG. 8 there is shown an exerciser where the roller platform assembly 8 is relatively flat. The user is grasping a bar of overhead hand bar assembly 30 wherein the user may do sit-ups while the user's body is supported by the roller platform assembly 8. The relative movement of part of the body in contact with the roller platform assembly 8 while doing sit-ups will provide a massaging action to the portion of the user's body moving relative to the roller platform assembly 8.

Figure 9:
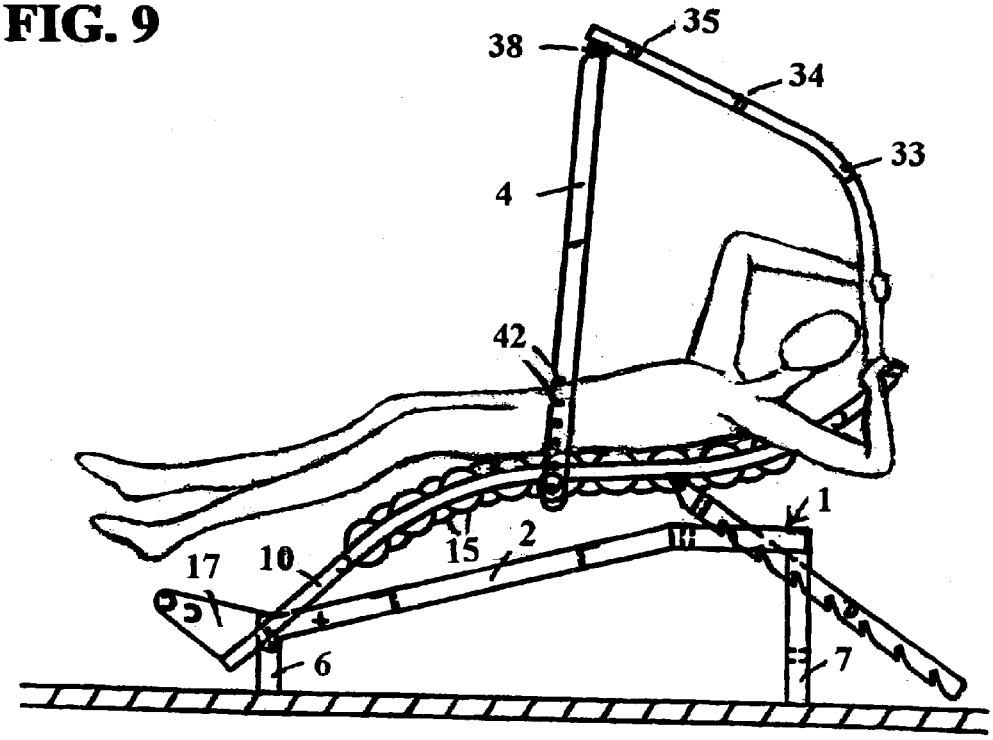
FIG. 9 is a cross-sectional view of the exerciser in a lower incline position with a user performing stretching exercises in a prone position.

In FIG. 9, the roller platform assembly 8 is relatively flat and the user's body is lying down as opposed to the sitting position shown in FIG. 8. Different bars of the overhead hand bar assembly 30 are grasped so that the user may push and pull the user's body over the roller platform assembly 8.

Figure 10:
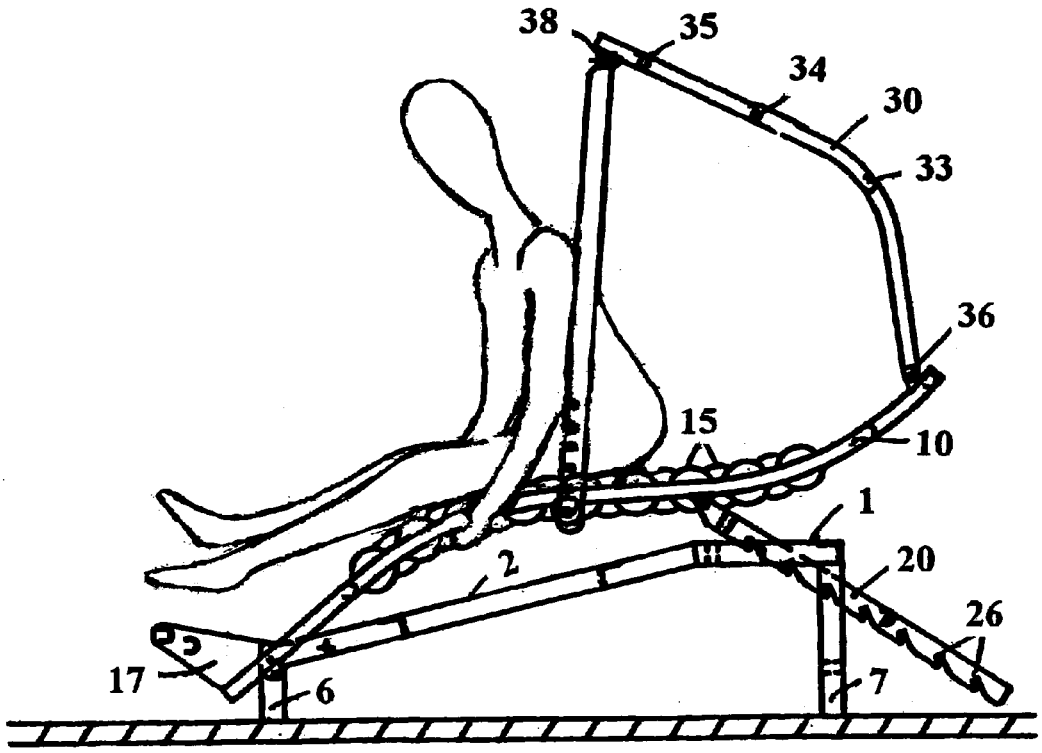
FIG. 10 is a cross-sectional view of the exerciser in a lower incline position with a user in a sitting position massaging the back of the legs and buttocks.

In FIG. 10 the user is sitting on the roller platform assembly 8 and grasping the sides 9 and 10 of the roller platform assembly 8. In this position the user may massage the back of the user's lower limbs on the roller platform assembly 8.

Figure 11:
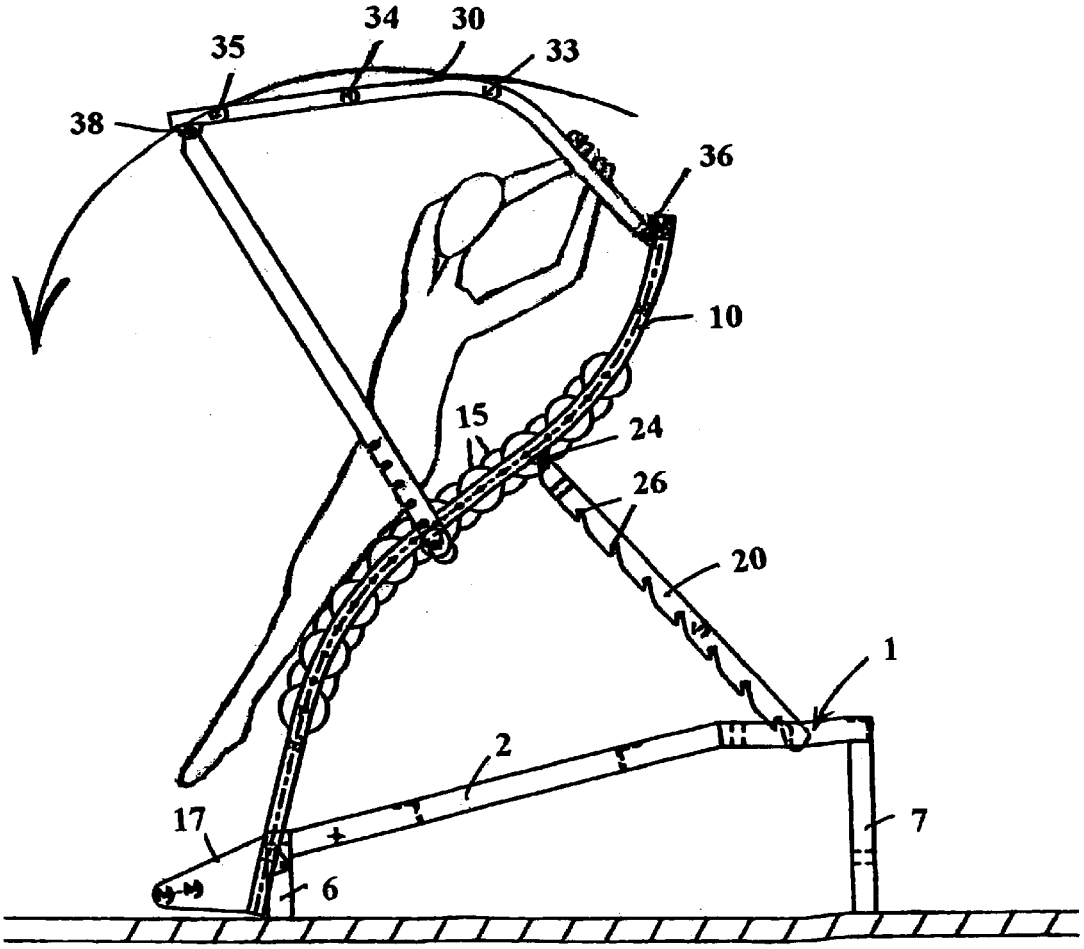
FIG. 11 is a cross-sectional view of the exerciser in a highly inclined position with a user in a standing position.

Referring to FIG. 11 there is shown a cross-sectional view of the exerciser with the roller platform assembly 8 and the overhead hand bar assembly 30 in a very inclined position. The user's feet are supported in foot supports 19, 20. The user may grasp one or more hand bars of the overhead hand bar assembly and do arm curls or other exercises while the user's body is being lightly massaged. Alternatively, the user may turn through 180 degrees and face in the opposite direction. With the user's feet in foot supports 19, 20 the user may carry out leg exercises by squatting and returning to a standing position.

In operation the user chooses the inclination of the roller platform assembly 8 consistent with the amount of exertion which the person using the exerciser wishes to exert in doing the exercise. For instance, doing a sit-up by utilizing an overhead bar requires less energy when the roller platform assembly is arranged at seventy-five degrees than the roller platform assembly is arranged at twenty-five degrees to horizontal. Similarly, the pressure applied by the body to the rollers 15 and by the rollers 15 to the body is more when the roller platform assembly is fixed at twenty-five degrees relative to horizontal than when the roller platform assembly is fixed at seventy-five degrees relative to horizontal. The gravitational pressure exerted by the body increases between the seventy-five degree inclination and the twenty-five degree inclination positions of the roller platform assembly. The inclination of the roller platform assembly 8 is selected by selecting the notches 26 of roller platform assembly supports 20, 21 on transverse support rod 27.

The distance between overhead hand bar assembly 30 and roller platform assembly 8 is carried out in the same fashion by selecting notches 42 in the sides of overhead hand bar assembly supports 40, 41 to be placed in transverse rod 43 connected to the roller platform assembly 8.

After selecting and setting the desired inclination of the roller platform assembly 8 and the desired height of the overhead hand bar assembly 30, the user will place the user's feet in foot supports 19, 20 and place the user's back against the rollers 15 of roller platform assembly 8. The user may grasp one of the transverse supports 33, 34 and 35 of overhead hand bar assembly and slide the user's body upwardly or downwardly relative to the rollers 15 of roller platform assembly 8. The body of the user may be moved with arms or by the user's legs bending or straightening relative to foot supports 19, 20.

Figure 12:
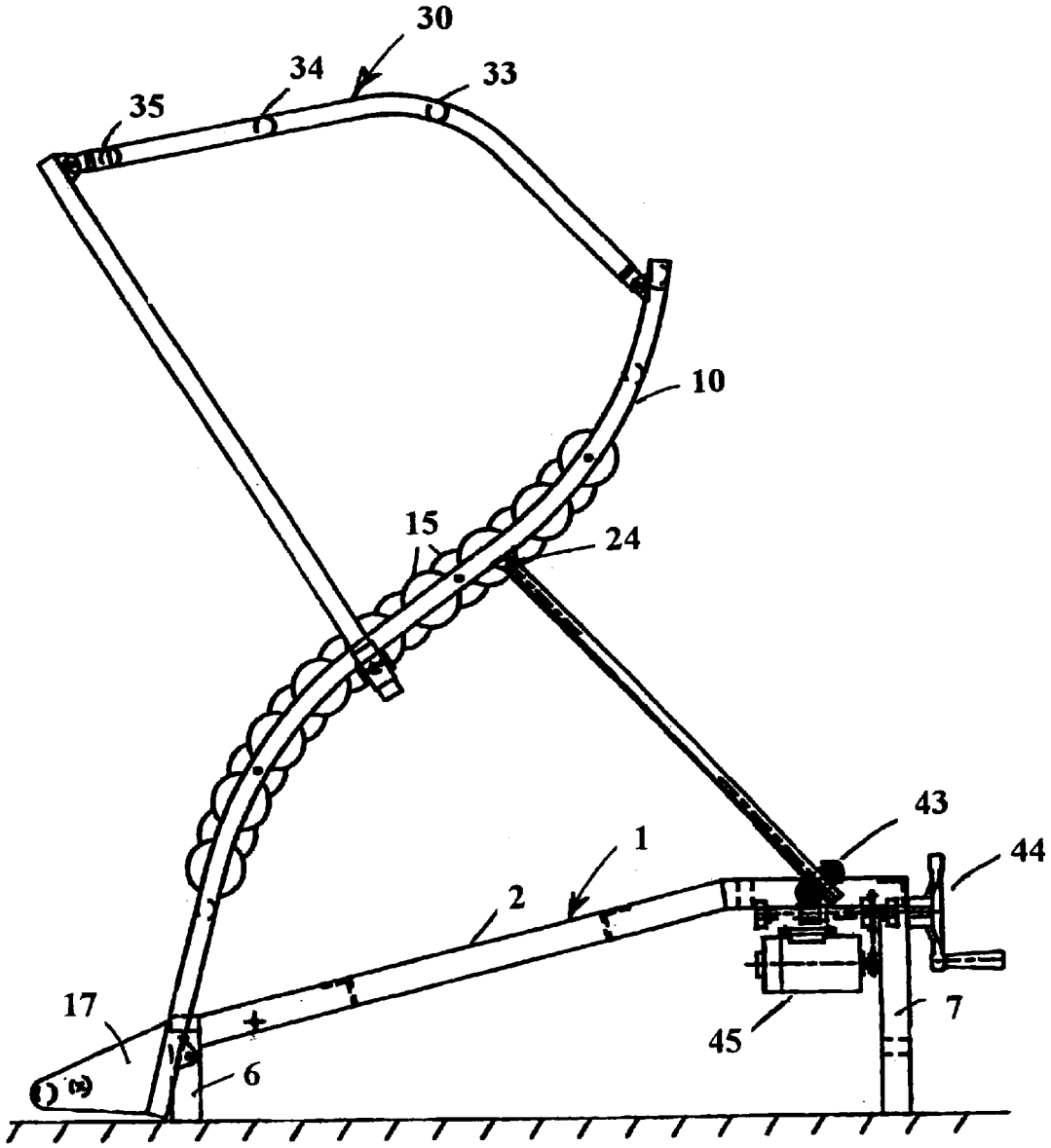
FIG. 12 is a side elevation view of the exerciser with a manual and motorized roller platform adjustment with the roller platform in highly inclined position.

While the description shows the use of notches 26 on roller platform assembly supports 20, 21 and notches 42 on overhead hand bar assembly supports 40, 41 to selectively arrange distances between the roller platform assembly 8 and the base module 1 and between the overhead hand bar assembly 30 and the roller platform assembly 8, it will be recognized by those skilled in the art that gears or other mechanical means powered by hand or by motors may be substituted for the mechanism disclosed in the description without departing from the invention. One of the many mechanisms which could be used is shown in FIG. 12. FIG. 12 discloses a worm gear 43 which can be turned by handle 44 or by motor 45. The mechanism shown in FIG. 12 will give the added advantage that the inclination can be arranged at any selected inclination within the selected range of inclinations.

What is claimed is:

1. An exerciser with an inclined adjustable roller platform assembly comprising a base module, a roller platform assembly, a foot support, a roller platform assembly support, an overhead hand bar assembly and an overhead hand bar assembly support, one end of the roller platform assembly is pivotally connected to the base, the foot support fastened to and extending forwardly of the base of the roller platform assembly, the adjustable roller platform assembly is maintained in one of many variable inclined positions by the roller platform assembly support extending between the roller platform assembly and the base module, the roller platform assembly support being variably vertically adjustable; the overhead hand bar assembly having a lower end pivotally connected to the roller platform assembly, overhead hand bar assembly supports extending between the overhead hand bar assembly and the roller platform assembly, the overhead hand bar supports being variably vertically adjustable.

2. The exerciser with an inclined adjustable roller platform assembly of claim 1 in which the roller platform assembly may be inclined between a twenty-five degree and seventy-five degree angle relative to horizontal.

3. The exerciser with an inclined adjustable roller platform assembly of claim 2 in which the upper end of the roller platform assembly support is pivotally connected to the roller platform assembly and the lower portion of the roller platform assembly support has indexed fastening means for fastening the roller platform assembly support to the base module at a selected indexed position.

4. The exerciser with an inclined adjustable roller platform assembly of claim 2 in which the overhead hand bar assembly has one end pivotally connected proximate the upper end of the roller platform assembly and the other end pivotally connected to the overhead hand bar assembly supports, the overhead hand bar assembly supports extending between the top of the overhead hand bar assembly and the roller platform assembly, the lower part of the overhead hand bar assembly supports having indexed fastening means for adjusting the overhead hand bar assembly at different vertical distances relative to the roller platform assembly.

5. An exerciser with an inclined adjustable roller platform assembly comprising a base module, a roller platform assembly, a foot support, an adjustable roller platform assembly support, an overhead hand bar assembly, and an adjustable overhead hand bar assembly support, the base module is comprised of a frame, legs and mounts, the frame has opposed side members connected at both ends of the side members by transverse supports, four legs extend vertically downward from corners at the juncture of the side members and transverse supports, a roller platform assembly having an elongated S shape comprising a roller assembly frame, mounts, roller rods, roller bushings and rollers, the roller assembly frame having identical side members having an elongate S shape, transverse end and intermediate members connecting said identical roller frame side members together, roller rods extending between roller assembly frame side members, rollers mounted on the roller rods, roller bushings mounted on the roller rods between rollers, the lower end of the adjustable roller platform assembly is pivotally fastened to mounts on the lower end of the sides of the base for turning movement about said mounts, the foot support extending forwardly of the base of the roller platform assembly, mounts on the opposed sides of the roller platform assembly, the roller platform assembly support pivotally connected to the mounts on the opposed sides of the roller platform assembly, the lower part of the sides of the adjustable roller platform assembly support including a series of spaced inclined notches, a rod transversely extending from side to side of the roller platform assembly adapted to receive and retain corresponding inclined notches of the adjustable roller platform assembly support, the overhead hand bar assembly having a frame and transverse hand bars, the frame comprised of two side members straight at either end and concave towards the center, a series of spaced transverse hand bars extending between the side members, the overhead hand bar assembly supports having apertures defining openings near the lower ends for connection to a transverse rod extending between the sides of the roller platform assembly, the adjustable overhead hand bar assembly frame having apertures at the outer ends defining an opening for pivotal connection to the upper end of the overhead hand bar supports, the lower part of overhead hand bar assembly supports having a series of spaced notches at its lower end for selective insertion on a transverse rod extending between the sides of the roller platform assembly.

6. The method of using the device of claim 1 of adjusting an inclined adjustable roller platform assembly of an exerciser having a base module, a roller platform assembly, a foot support, a vertically adjustable roller assembly support between the base module and roller platform assembly, an overhead hand bar assembly and a vertically adjustable overhead comprising the steps of removing the vertically adjustable roller assembly support from the roller platform assembly, reinstating the vertically adjustable roller assembly support at a new vertical position on the roller platform assembly.

7. The method of adjusting an inclined adjustable roller platform assembly of the exerciser of claim 6 in which the angle of incline of the roller platform assembly relative to horizontal is between twenty-five degrees and seventy-five degrees.

8. A method of adjusting the overhead hand bar support of the exerciser of claim 6 comprising the steps of removing the vertically adjustable overhead hand bar support from the roller platform assembly, reinstating the same at a different indexed position on the adjustable overhead hand bar support on the roller platform assembly.

9. The exerciser with an inclined adjustable roller platform assembly of claim 1, in which the roller platform assembly further comprises: A roller assembly frame mounts, roller rods, roller bushings and rollers the rolls assembly frame having identical side members, transverse end and intermediate members connecting said identical roller frame side members together, roller rods extending between roller assembly frame side members, rollers mounted on the roller. Rods other than the central portion of the roller rods, roller bushings mounted on the roller rods between rollers the distance between adjoining roller rods being slightly greater than the diameter of the rollers, roller on adjoining roller rods being offset from rollers on prior and following rollers rods by roller bushings such that a portion of the roller platform is formed of continuous interpresed sets of rollers extending outwardly from a rollerless central portion to either side of the roller platform.

* * * * *